US006431995B1

(12) United States Patent
Jackson

(10) Patent No.: US 6,431,995 B1
(45) Date of Patent: Aug. 13, 2002

(54) GOLF CLUB HEAD WITH NON-METALLIC FILLED CAVITY

(76) Inventor: Michael D. Jackson, 119 Willow Trace Ct., Clemons, NC (US) 27012

( * ) Notice: Subject to any disclaimer, the term of this patent is extended or adjusted under 35 U.S.C. 154(b) by 0 days.

(21) Appl. No.: 09/513,865

(22) Filed: Feb. 28, 2000

Related U.S. Application Data

(63) Continuation-in-part of application No. 09/073,174, filed on May 5, 1999, now abandoned.

(51) Int. Cl.[7] ..... A63B 53/04

(52) U.S. Cl. ..... 473/305; 473/309; 473/318; 473/332; 473/324

(58) Field of Search ..... 473/305, 306, 473/307, 308, 309, 310, 311, 312, 313, 314, 315, 318, 327, 350, 324, 332, 333, 334, 131, 290

(56) References Cited

U.S. PATENT DOCUMENTS 873,423 A * 12/1907 Govan
1,414,124 A * 4/1922 Griffin
5,226,659 A * 7/1993 Lo
5,326,106 A * 7/1994 Meyer
5,695,409 A * 12/1997 Jackson

FOREIGN PATENT DOCUMENTS

GB 322635 * 12/1929 ..... 273/169
JP 405305163 * 11/1993 ..... 273/167 F

* cited by examiner

*Primary Examiner*—Sebastiano Passaniti
(74) *Attorney, Agent, or Firm*—Coats & Bennett, P.L.L.C.

(57) ABSTRACT

The golf club of the present invention is comprised of an elongated shaft and a club head, where the club head further includes a striking face, a front toe region, a rear heel region, and opposing top and bottom edges. The elongated shaft is coupled to a hosel. Between the hosel and face there is defined a juncture region. The club also includes a small cavity, filled with a non-metallic material, which is located in the juncture region. In addition to enlarging the sweet spot of the club, the filled cavity serves to dampen or eliminate vibrations that are established in the club body as the striking face contacts a ball during the course of a typical golf swing.

10 Claims, 1 Drawing Sheet

GOLF CLUB HEAD WITH NON-METALLIC FILLED CAVITY

The present application is a continuation of U.S. patent application Ser. No. 09/073,174, filed May 5, 1999, now abandoned, the entire disclosure of which is hereby incorporated by reference.

FIELD OF THE INVENTION

The present invention relates to a golf club and more particularly to a golf club which includes a non-metallic or polymer filled cavity at the juncture formed between the shaft and the club head.

BACKGROUND OF THE INVENTION

As the sport of golf increases in popularity and competition within the golfing industry also grows, it has become increasingly important for golf club manufacturers to improve and enhance the playability of their clubs through new design innovations and the application of current technology. These playability enhancements typically involve design attributes which provide for more forgiving or more powerful club characteristics that ultimately lead to improved hitting distance, and/or improved ball control and accuracy.

While there have been numerous design innovations through the years, such as U.S. Pat. Nos. 5,447,307 and 5,056,788 for example, which propose to alter the mechanical characteristics of a golf club and subsequently improve swing efficiency by preferentially distributing mass towards the rear portion of the club head, of particular significance and relevance to the present invention is U.S. Pat. No. 5,695,409. As such, U.S. Pat. No. 5,695,409 discloses a golf club design that incorporates a penetration or open cavity in or about the junction region formed between the shaft and club head. This club design serves to provide an enlarged sweet spot, which in turn acts to improve the accuracy and consistency of the golfer's swing. While the above mentioned club design may improve a golfer's accuracy and consistency to some measurable degree, there remains the possibility of further improvement through the reduction of high-energy vibrations which are often established within the body of a club and subsequently transmitted to the golfer during the course of a ball-impacting swing. Such vibrations are indicative of a less than ideal transfer of energy from the club to the ball, and consequently represent an inefficiency in the club.

Therefore there is and continues to be a need for a golf club which provides the golfer with improved accuracy and consistency, while simultaneously reducing or eliminating energy transfer inefficiencies related to vibrations which are established within the club head during the ball impact portion of a club swing.

SUMMARY OF THE INVENTION

The present invention entails a golf club that includes a non-metallic insert incorporated into the head of the golf club for dampening vibrations that are directed through the golf club. More particularly, the golf club includes a face and a hosel extending adjacent one side of the face. Formed between the hosel and the face is an area that is generally referred to as a juncture region. Formed in this juncture region is a cavity that receives and holds the non-metallic insert.

Various types of materials can be used for the non-metallic insert. For example, these materials may include epoxy, polymers, rubber materials and viscoelastic materials in general.

It is therefore an object of the present invention to provide a golf club having a non-metallic insert dampener formed in the juncture region of the club head for dampening vibration transmitted from the face of the club through the juncture region to the hosel in response to the head impacting a golf ball.

Other objects and advantages of the present invention will become apparent and obvious from a study of the following description and the accompanying drawings which are merely illustrative of such invention.

DETAILED DESCRIPTION OF THE INVENTION

Figure 2:
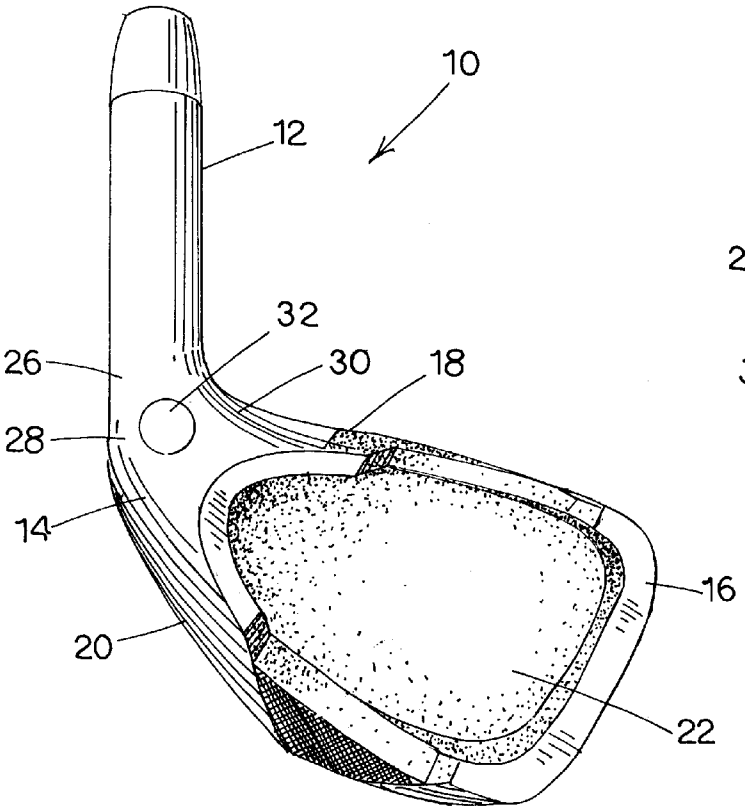
FIG. 2 is a rear elevational view of the golf club of the present invention generally illustrating the rear face of the club head.
Figure 1:
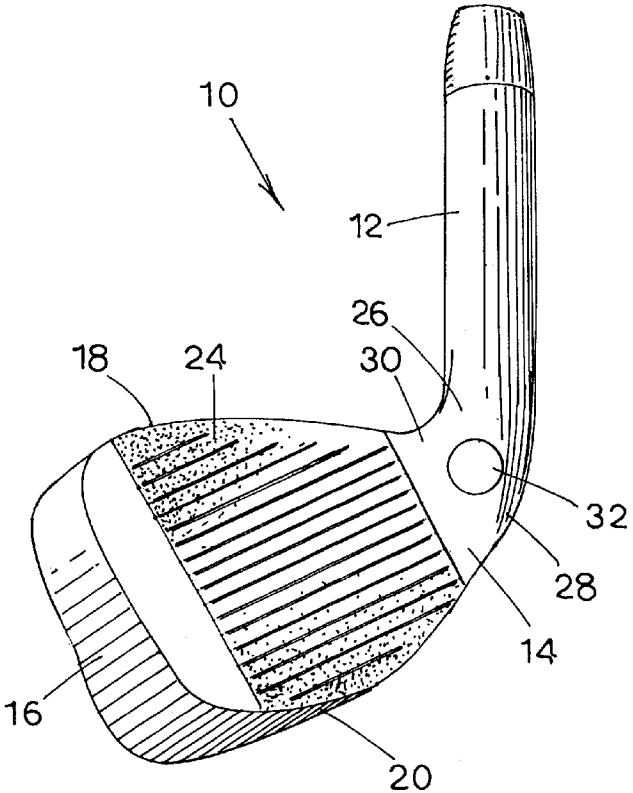
FIG. 1 is a front elevational view of the golf club of the present invention generally illustrating the front or striking face of the club head.

Shown in FIGS. 1 and 2 are elevational views of the golf club of the present invention, illustrating the club head which is generally indicated by the numeral 10. Club head 10 comprises a rear heel region 14, a front toe region 16, a rear face 22, a front striking face 24, and opposing top and bottom edges 18 and 20, respectively. Attached to the rear heel region 14 of the club head 10 via a hosel 12 is an elongated shaft (not shown), which is of sufficient length to be gripped by a golfer in the usual manner. Being so joined, hosel 12 and heel region 14 generally form or define a juncture region 26, as shown in FIGS. 1 and 2. In some cases the juncture region 26 may be disposed at an angle with respect to the face 24 or club head 10. That is, the juncture region 26 may extend forwardly and outwardly from the face 24. Alternatively, the juncture region 26 may be oriented such that it generally aligns with the face 24 or extends generally parallel to the face 24. Disposed within and generally through the juncture region 26 is a non-metallic filled opening or cavity 32, where the non-metallic plug or filling serves to effectively dampen vibration in the club head 10 in response to the club head impacting a golf ball.

Figure 3:
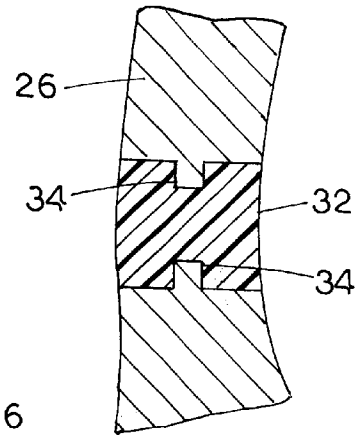
FIG. 3 is cross-section view of the juncture region of the golf club of the present invention generally illustrating the non-metallic filled cavity.

In the particular embodiment described herein, the passageway defined by the cavity 32 is generally cylindrical in shape and is oriented within the juncture region 26 so as to communicate with both the front and rear faces of the club head 10. While the radius of cavity 32 may be varied to meet specific club head design requirements, a cavity radius which provides an opening area in the range of approximately 2.5 $mm^2$ to 3.0 $mm^2$ is preferable. With further regard to the cavity 32, the interior of the passageway defined therein contains a finger-like protrusion or locking flange 34 which serves to support and retain the hardened non-metallic filling, as shown in FIG. 3.

As a consequence of the positioning of the cavity 32 within the juncture region 26, the cavity 32 effectively divides the juncture region 26 into an upper juncture span 30 and a lower juncture span 28. From a mechanical strength standpoint, the juncture spans 28 and 30 may be designed thicker in the transverse plane of the cross section, (i.e., the depth dimension) in order to compensate for any structural weakness introduced by the cavity 32. That is, the shape and thickness of the spans 28 and 30 may be chosen so as to provide additional structural rigidity in compensation for any lost rigidity associated with the absence of high strength material in the cavity 32.

In practice, club heads of the type contemplated herein are typically fabricated of a metal alloy using a die casting technique. As such, the cavity 32 is generally incorporated into the casting die such that the opening or passageway is formed as the molten metal alloy is poured into and solidifies within the mold. Once removed from the casting die, the rough casting of the club head 10 is typically machined to remove any burrs or surface blemishes. Placement of the non-metallic plug within the open cavity 32 involves placement of the club head 10 into an oven that has been pre-heated to approximately 170 degrees Fahrenheit. Just prior to placement of the club head 10 within the pre-heated oven, a generally viscous non-metallic compound is poured into one end of the open cavity 32. A temporary plug may be inserted or positioned over the opposing end of the cavity 32 so as to generally prevent the viscous non-metallic compound from escaping the cavity prior to curing or hardening.

Given the viscous or fluid-like nature of the uncured non-metallic compound, the non-metallic compound tends to initially flow through the generally cylindrical cavity passageway and around the finger-like projection or locking flange 34 formed within the cavity 32. The non-metallic compound is then allowed to set and harden at the elevated oven temperature for approximately 8 to 12 minutes. Once the non-metallic compound has cured or hardened, the temporary plug is removed, leaving a cavity that is filled only with non-metallic material. With further regard to the issue of temporarily plugging one end of the cavity 32 during the filling operation, one technique for accomplishing this task requires that a thin wall of metal be left at one end of the cavity 32 during the die casting operation. Once the non-metallic material has been poured within the cavity 32 and has hardened or cured sufficiently, the thin wall may be removed via a relatively minor machining process.

The cavity 32 may be filled with various types of non-metallic material that exhibit dampening properties. For example, the cavity filling material may include such materials as epoxy, rubber, various polymers, or other viscoelastic materials or compounds which exhibit vibration dampening properties that are superior to those base metals that are typically used in golf club heads.

Alternatively, the golf club of the present invention could be formed by a forging process. Although the cavity 32 may be formed by the forging process itself, it is contemplated that after forging the golf club, then the cavity 32 could be formed in a conventional manner by drilling.

As mentioned previously, the golf club of the present invention discussed and described herein incorporates all of the advantages and benefits of the club disclosed in U.S. Pat. No. 5,695,409, the disclosure of which is expressly incorporated herein by reference. That is, inclusion of the cavity 32 serves to provide an enlarged sweet spot for the club, which in turn acts to improve the accuracy and consistency of the golfer's stroke. The club of the present invention further provides the added benefit of reducing undesirable vibrations which are established within the body of the club and subsequently transferred to the golfer during and after the club face strikes a ball.

The present invention may, of course, be carried out in other specific ways than those herein set forth without parting from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A golf club comprising: a head; a shaft; the head including a neck that extends to and connects to the shaft; at least one cavity formed in the neck; and a non-metallic insert disposed within the cavity and including an exposed outer face that lies adjacent a surrounding area of the neck such that the non-metallic insert is generally confined to the cavity.

2. The golf club of claim 1 wherein the cavity extends entirely through the neck of the golf club and wherein the non-metallic insert fills the cavity and includes opposed outer exposed faces each of which lies generally flush with the surrounding neck area.

3. The golf club of claim 1 formed by casting the head and forming the cavity within the neck during the casting process; after casting, filling the cavity with a liquid non-metallic material; and thereafter curing the liquid non-metallic material within the formed cavity to form the non-metallic insert.

4. The golf club formed by the process of claim 3 wherein curing the liquid non-metallic material includes heating the non-metallic material and the head for a selected time period at a selected temperature.

5. The golf club formed by the process of claim 3 including forming a relatively thin retaining wall in the cavity during the casting process; and utilizing the relatively thin wall to hold the liquid non-metallic material within the cavity during curing.

6. The golf club formed by the process of claim 5 including removing the relatively thin wall from the cavity after the non-metallic material is cured.

7. The golf club formed by the process of claim 3 wherein the liquid non-metallic material filled within the cavity is a viscoelastic material.

8. A golf club comprising: a head; a shaft; a head including a face and a neck that extends to and connects to the shaft; at least one cavity formed in the neck; and dampening means formed in the cavity within the neck for dampening vibrations transmitted from the face to the shaft in response to a golf ball impacting the face.

9. The golf club of claim 8 wherein the dampening means includes a non-metallic insert that is disposed within the cavity and wherein the non-metallic insert is confined within the cavity and includes at least one exposed face that lies flush with a surrounding area of the neck.

10. The golf club of claim 9 formed by casting the head and forming the cavity within the neck during the casting process; after casting, filling the cavity with a liquid non-metallic material; and thereafter curing the liquid non-metallic material within the formed cavity to form the non-metallic insert that is disposed within the cavity.

* * * * *